US006902441B2

(12) United States Patent
Sablatzky

(10) Patent No.: US 6,902,441 B2
(45) Date of Patent: Jun. 7, 2005

(54) MODULAR LAYERED STACKABLE CONNECTOR SYSTEM

(75) Inventor: Neil Sablatzky, Howell, MI (US)

(73) Assignee: Alcoa Fujikura Limited, Brentwood, TN (US)

( * ) Notice: Subject to any disclaimer, the term of this patent is extended or adjusted under 35 U.S.C. 154(b) by 56 days.

(21) Appl. No.: 10/661,700

(22) Filed: Sep. 12, 2003

(65) Prior Publication Data

US 2005/0059302 A1 Mar. 17, 2005

(51) Int. Cl.[7] ..... H01R 9/22
(52) U.S. Cl. ..... 439/714; 439/518; 439/701
(58) Field of Search ..... 439/714, 518, 439/701, 171, 173, 174, 189, 715

(56) References Cited

U.S. PATENT DOCUMENTS

| | | | | | |
|---|---|---|---|---|---|
| 3,016,512 | A | * | 1/1962 | Borchard | 439/225 |
| 3,054,078 | A | * | 9/1962 | Baschkin | 439/44 |
| 4,820,204 | A | * | 4/1989 | Batty | 439/681 |
| 4,981,442 | A | | 1/1991 | Shimizu et al. | 439/394 |
| 5,018,985 | A | * | 5/1991 | Moore | 439/174 |
| 5,281,161 | A | * | 1/1994 | Kanai | 439/357 |
| 5,365,659 | A | | 11/1994 | Ueda et al. | 29/863 |
| 5,649,626 | A | | 7/1997 | Sawamura et al. | 206/728 |
| 6,139,341 | A | * | 10/2000 | Hun | 439/172 |
| 6,328,581 | B1 | * | 12/2001 | Lee et al. | 439/106 |
| 6,361,355 | B1 | * | 3/2002 | Matsuoka et al. | 439/488 |
| 6,431,894 | B1 | * | 8/2002 | Boiret et al. | 439/189 |
| 2002/0001996 | A1 | | 1/2002 | Seki | 439/403 |
| 2002/0076990 | A1 | | 6/2002 | Fujita | 439/701 |

* cited by examiner

*Primary Examiner*—Ross Gushi
(74) *Attorney, Agent, or Firm*—Tracey D. Beiriger; Eckert Seamans Cherin & Mellott, LLC

(57) ABSTRACT

A connector system for use with first and second wire harnesses and including a male housing sub-assembly and an engageable and female housing sub-assembly which defines an open interior therebetween. First and second pluralities of terminal pins are associated with each of the male and female sub-assemblies, individual wires associated with each of the first and second wire harnesses extending to selected ones of the first and second pluralities of terminal pins. Each of the male and female sub-assemblies further include any plurality of individual and stackable terminal retaining layers, and to which subset pluralities of the pins are secured. The stackable pin retaining layers provide the ability to adapt the capabilities of the connector system to allow for unique wire harness subsystems to be quickly assembled and to minimize unwanted "giveaway" of excess capacity in a base connector assembly.

17 Claims, 8 Drawing Sheets

MODULAR LAYERED STACKABLE CONNECTOR SYSTEM

FIELD OF THE INVENTION

The present invention relates generally to wire harness connector systems, most notably those associated with commercial vehicle installations. More particularly, the present invention relates to a modularized connector system, such as in which either or both of male and female connector sub-assemblies include the ability to stack or interengage any plurality of individual terminal retention layers. The purpose behind the ease of modularity is to provide the ability to adapt the capabilities of the connector system to allow for unique wire harness subsystems to be quickly assembled, either in the field or factory, thus reducing assembly labor, eliminating assembly/wiring errors, and reducing the need for unique wire harness levels.

BACKGROUND OF THE INVENTION

The prior art is well documented with various types of connector assemblies, and which are typically in use with vehicle wire harnesses. It is common to require a uniquely designed wire harness for each combination of options associated with a given installation, these including such as automotive, telecommunications, aircraft, commercial and other consumer applications. The shortcoming of the prior art has been the inability to allow for modularity of wire harnesses, employing a standardized connector housing, and in order to satisfy a range of load and output requirements.

SUMMARY OF THE INVENTION

The present invention is a connector system for use with wire harness assemblies. In particular, the system provides for the ability to modularize the capacity of the connector through the provision of any plurality of individual and stackable terminal retention layers, on either or both of interconnecting male and female sub-assembly portions, and in order to quickly adapt the capabilities of the connector system to allow for the assembly of unique wire harness subsystems.

Each of the male and female sub-assemblies includes a three dimensional and interengaging housing which, in combination, defines an open interior. First and second pluralities of inter-engageable terminal pins are associated with each of the male and female sub-assemblies and each of the sub-assemblies further includes a plurality of individual and stackable retaining layers to which individual sub-pluralities of the pins are secured.

The exposed ends of the housing sub-assemblies are each enclosed by a slit matt seal and a two-piece seal retainer. It is also contemplated that each of the plurality of succeeding and stackable retainer layers includes a given array of apertures to both facilitate mounting of selected pins, as well as to permit passage therethrough of differently lengthened pins associated with preceding layers and wire passage. Conductive inserts may also be secured between succeeding terminal pin retaining layers, to effectively short out electrical connections between pins associated with the succeeding layers or prior layers, and it is also contemplated that active or passive electronic, electro-mechanical, or mechanical components, such as fuses, relays and the like, can be incorporated into any of the layers.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF PREFERRED EMBODIMENTS

Figure 1:
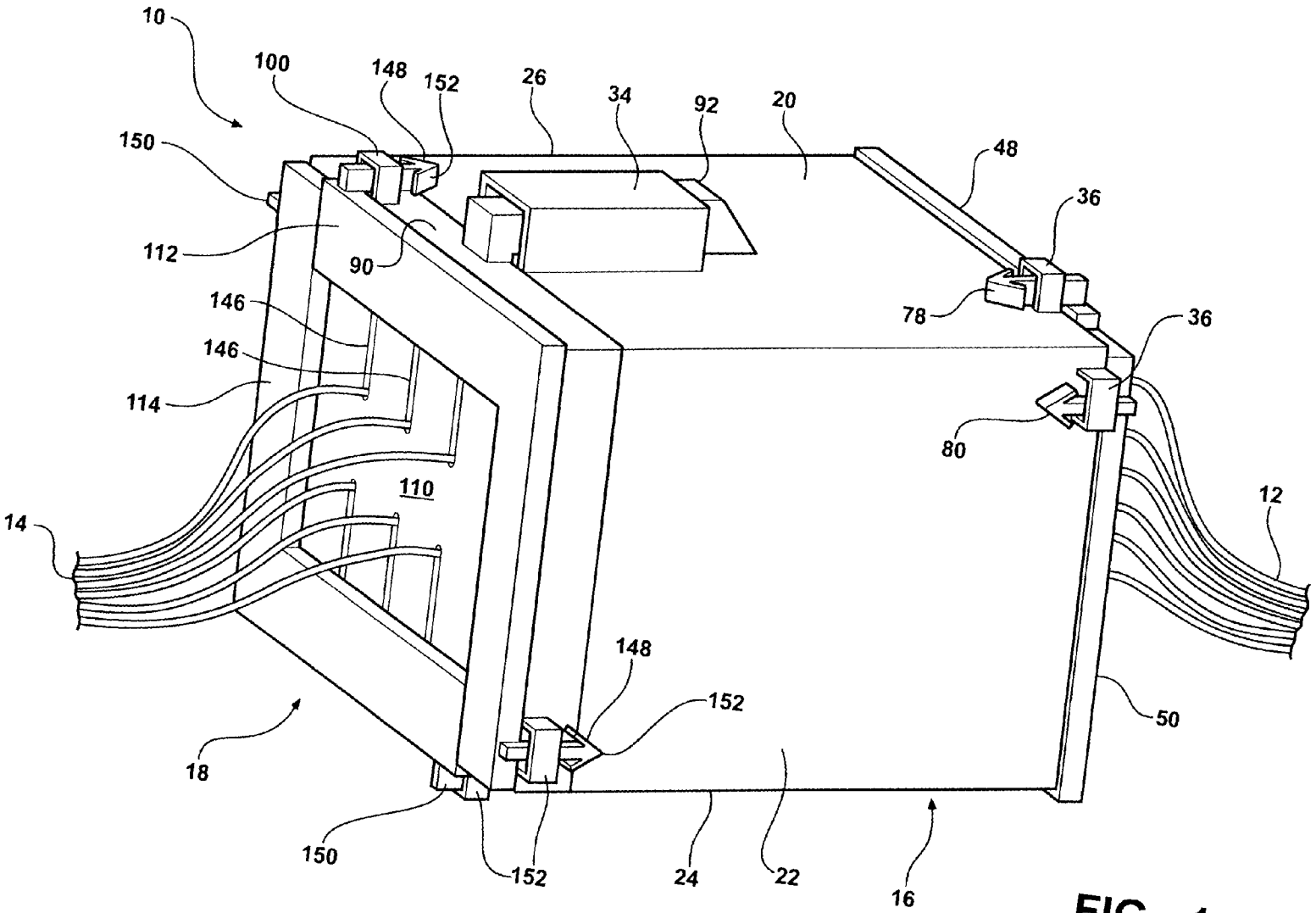
FIG. 1 is a perspective view of the modular layered connector system according to the present invention and further illustrating wire harnesses extending from both of assembled male and female subassembly portions.

Referring now to FIG. 1, a perspective view is shown at 10 of a modular layered connector system according to a preferred embodiment of the present invention and which further illustrates individual wire harnesses 12 and 14 extending, respectively from each of assembled male 16 and female 18 sub-assembly portions. As previously explained, either or both of male and female connector sub-assemblies include the ability to stack or interengage any plurality of individual terminal retention layers. The purpose behind the modularity of construction is further to adapt the capabilities of the connector system to allow for unique wire harness subsystems to be quickly assembled, thus minimizing wasteful and unwanted "giveaway" of excess/unneeded connector capacity, reducing assembly labor, eliminating assembly/wiring errors, and reducing the need for unique wire harness levels.

Figure 2:
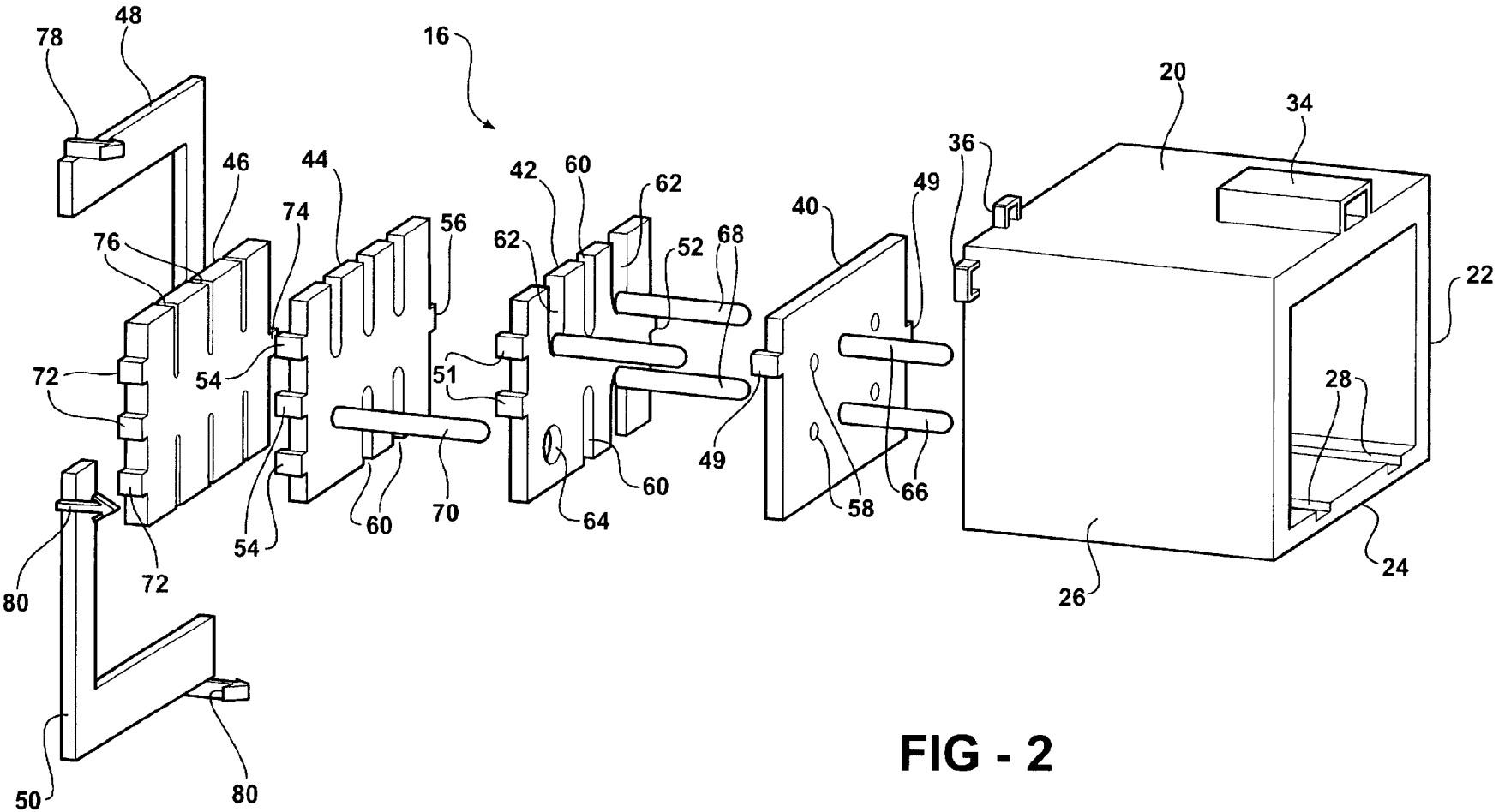
FIG. 2 is an exploded view of a subset male assembly according to the present invention.
Figure 3:
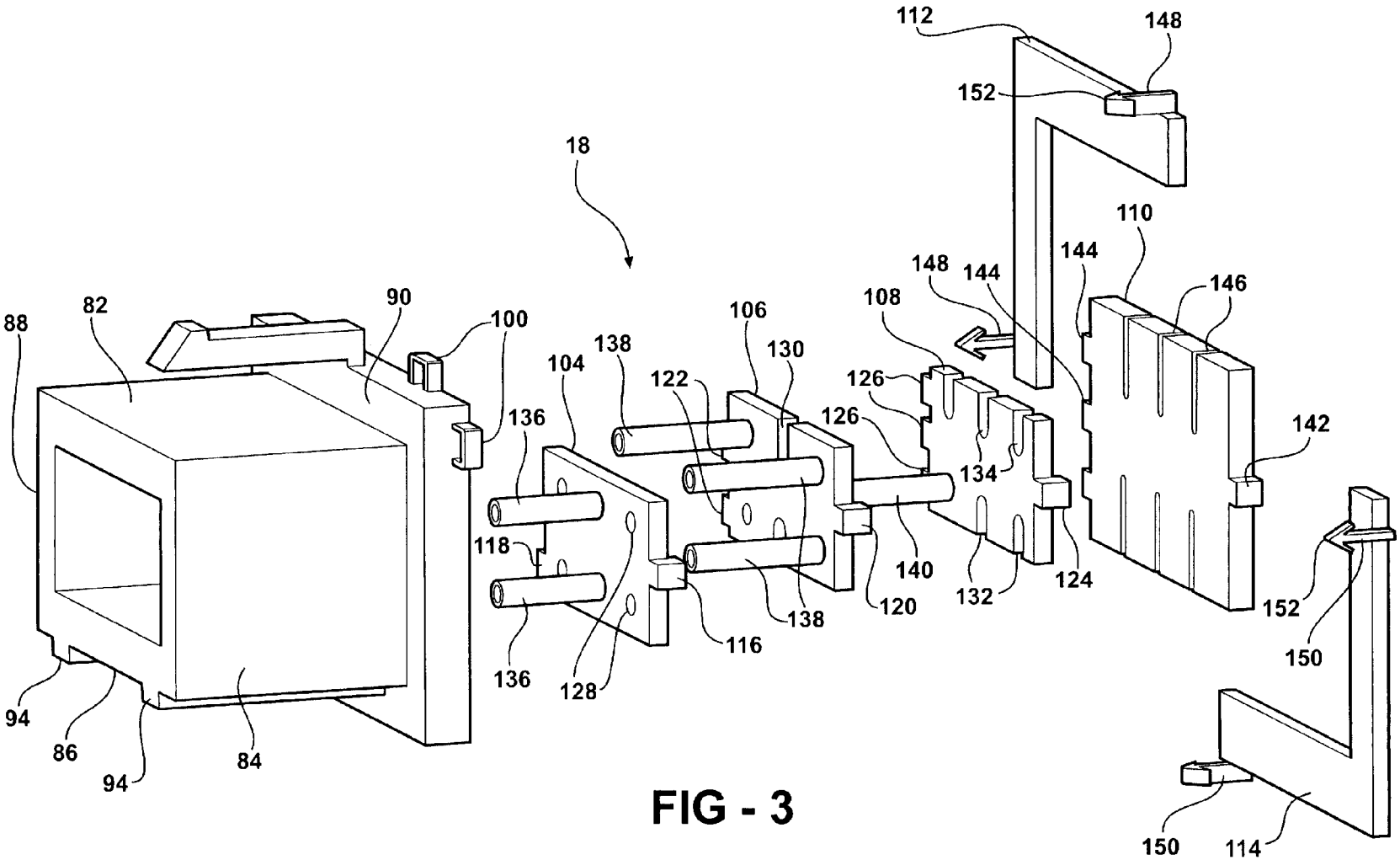
FIG. 3 is an exploded view of a subset female assembly according to the present invention.
Figure 5A:
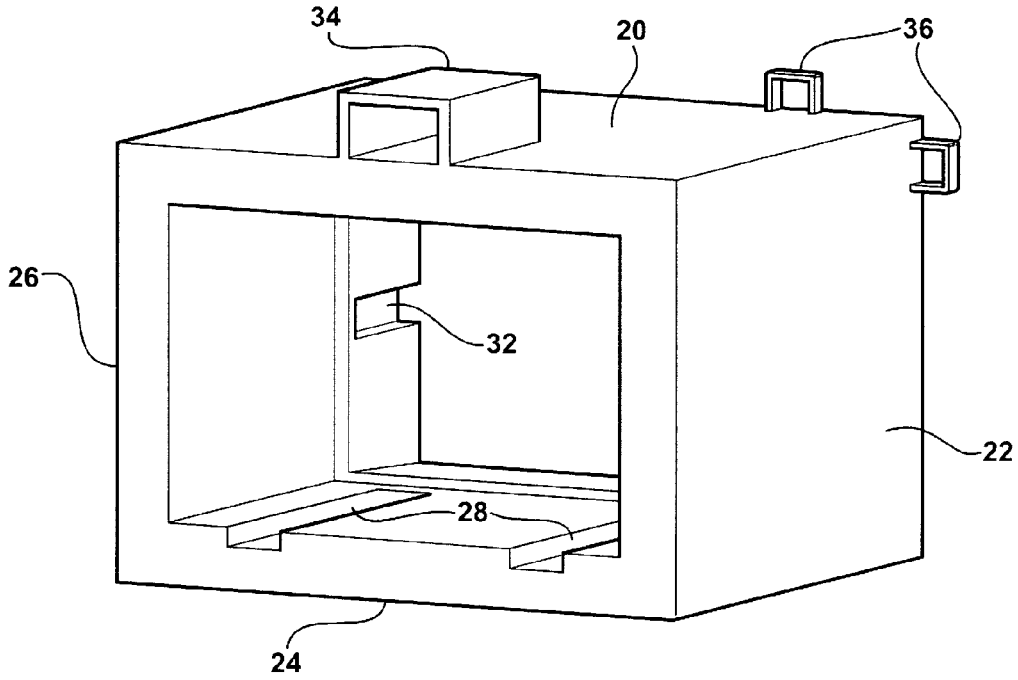
FIG. 5A is a frontal perspective view of the male housing subassembly according to the present invention.
Figure 5B:
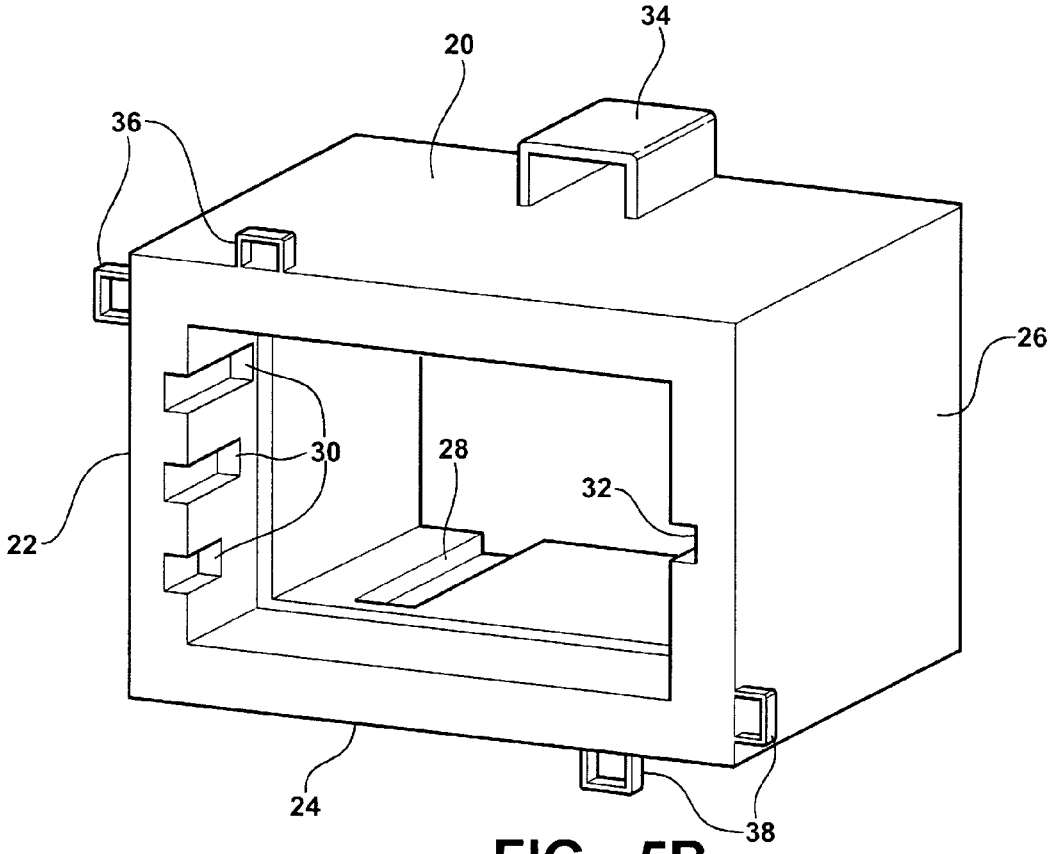
FIG. 5B is a rear perspective view of the male housing subassembly illustrated in FIG. 5.

Referring again to FIG. 1, as well as to FIGS. 2 and 3 in succession, the connector system 10 is constructed of two individual and inter-connectible subassemblies, including a first or male sub-assembly 16 (FIG. 2) and a second or female sub-assembly 18 (FIG. 3). Referring also to front are rear perspective looking views of FIGS. 5A and 5B, the male sub-assembly 16 includes a three dimensional shaped housing, generally rectangular in configuration and with first 20, second 22, third 24 and fourth 26 interconnecting sides.

The interconnecting sides, 20, 22, 24 and 26 defining the male sub-assembly further exhibit both outwardly and inwardly facing surfaces, thus defining a substantially open interior. Additional features associated with the male sub-assembly housing include a pair of inwardly recessed grooves 28 extending in depth-wise extending fashion along a bottom inner surface (see side 24), as well as additional depth-wise extending recesses 30 (FIG. 5B and 32) (FIG. 5A) positioned along inner facing surfaces of sides 22 and 26, respectively, the significance of which will be shortly discussed. Also configured, on selected exterior facing surfaces of the main housing sub-assembly, is a substantially rectangular shaped and interiorly open receiving portion 34 (see exterior facing surface of upper-most side 20). Additionally, first 36 and second 38 pairs of exteriorly projecting window portions are positioned proximate to both rearward and forward facing ends of the main housing sub-assembly.

Referring again to the exploded view of FIG. 2, additional features of the male sub-assembly 16 include the provision of a plurality of stackable and sandwiching components, these including individual terminal pin retaining layers 40, 42 and 44, a slit matt seal 46 and a two piece seal retainer (see substantially "L" shaped and assembleable components 48 and 50). Each of the terminal pin retaining layers 40, 42, and 44 are, in a preferred embodiment, rectangular in shape and are capable of being constructed of an insulating or conductive material, depending upon the electrical needs of the connector assembly.

Furthermore, in the preferred embodiment, each includes exteriorly projecting keys, or tabs, see such as at 47 and 49 for layer 40, at 51 and 52 for layer 42, and at 54 and 56 for layer 44. The uniquely configured and projecting tabs are intended to mate with the likewise uniquely/inwardly keyed recesses 30 and 32, these further being positioned and individually dimensioned in length to receive each of the succeeding pin retainer layers 40, 42 and 44 in a predetermined spaced and stacking arrangement.

As is also best illustrated in FIG. 2, each of the layers 40, 42 and 44 includes a plurality of configured apertures formed therethrough, these being selected from such as smaller circular shaped apertures (see at 58 for layer 40), as well as slot shaped 60, oval shaped 62 and larger sized circular shaped 64 apertures (see in particular layer 42). Individual pluralities of male terminal pins, 66 for layer 40, 68 for layer 42 and 70 for layer 44, are provided. Each sub-plurality of pins is dimensioned to a different length (such as the forward most layer 40 and pins 66 being the shortest and the rearward most layer 44 and pins 70 being the longest) and so that, upon assembly of the pins into specified circular shaped apertures (see again at 58) of each terminal layer 40, 42 and 44 of the male sub-assembly 16, the extending ends of the pins 66, 68 and 70 are all evenly arranged.

The arrangement and configuration of the variously shaped apertures (e.g. at 58, 60, 62 and 64) is further such that the longest pins (see again 70 associated with rearward most layer 44) are able to pass through the preceding and forwardly located layers 40 and 42 in the assembled stacking arrangement of the male sub-assembly 16. As will also be discussed in further detail, and referenced in the alternate sectional view of FIG. 11, individual wire strands composing the first wire harness 12 are connected to associated rearward ends of likewise individual ones of the male terminal insertion pins 66, 68 and 70. The configuration of the oval slots and channels in particular facilitates the clearance for previous layer terminal pins and wires (for example slots 60 in layers 42 and 44 allow for attached wire strands to clear existing attached wire strands in preceding layers) and it is also contemplated and understood that any suitable plurality of retaining layers and associated terminal pins can be installed into the male sub-assembly, the same only being limited by practical space considerations.

Referencing further the rearwardly positioned slit matt seal 46 (again FIG. 2), the same is shaped similarly to each of the succeeding pin retainer layers 40, 42 and 44, and includes keyed or tabbed portions, see at 72 and 74 and for positioning the matt seal 46 in a rearward most location, as well as smaller sized slits 76 for allowing clearance of the harness wires 12 associated with the pins 66, 68 and 70. Finally, the two piece seal retainer, see again at 48 and 50, is by necessity constructed in this fashion and so that it can be assembled around the wire harness extending from the male sub-assembly 16. End extending and keyed portions 78 (for retainer portion 48) and 80 (for retainer portion 50) are configured to engaged specified and associated window portions 36 and 38 of the male housing and in order to secure the male assembly together in the manner substantially illustrated in FIG. 1.

Referring again to FIG. 1, as well as to the exploded view of FIG. 3 and the individual front and rear perspective illustrations of FIGS. 6A and 6B, a similar explanation of the components associated with the female housing sub-assembly 18 will now be made. In providing this explanation, duplicate explanation of common elements discussed in reference to the male sub-assembly 16 will be, to the extent possible, avoided and in the interests of clarity and non-repetition.

Figure 6B:
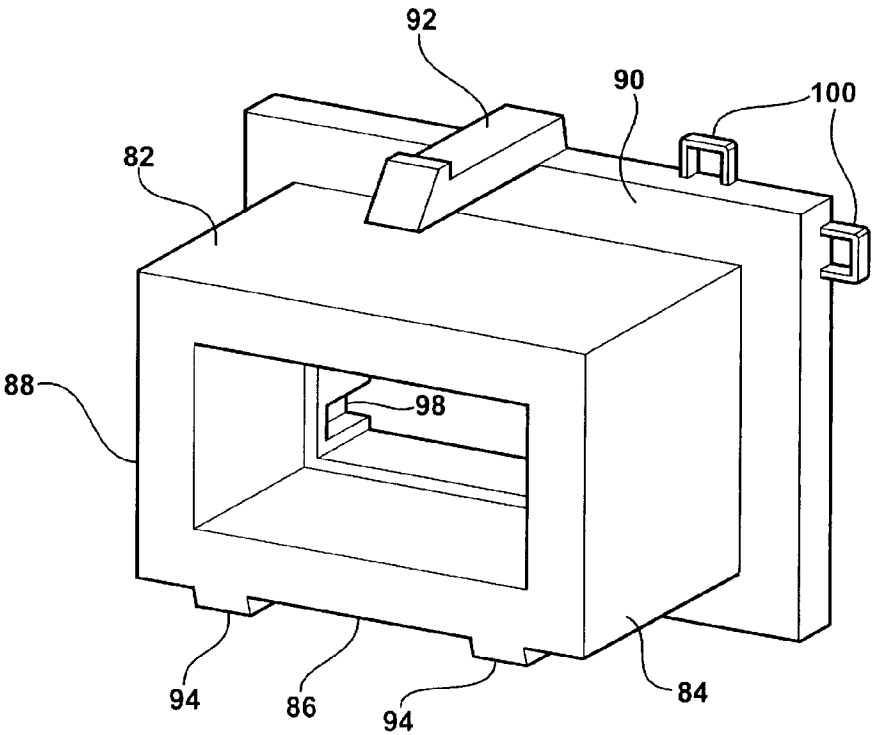
FIG. 6B is a frontal perspective view of the female housing subassembly illustrated in FIG. 6A.
Figure 6A:
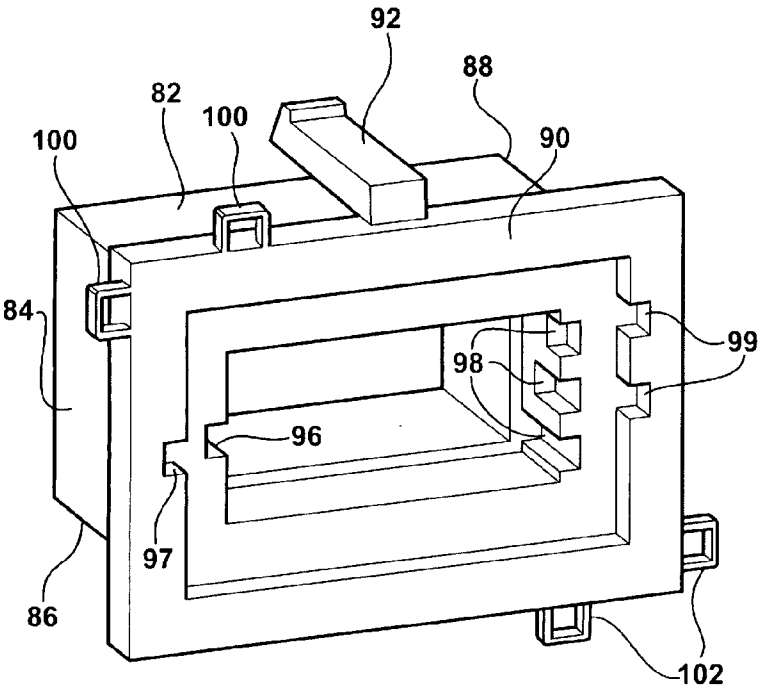
FIG. 6A is a rear perspective view of the female housing subassembly according to the present invention.

The above said, and referring again to front are rear perspective looking views of FIGS. 6A and 6B, the female sub-assembly 18 also includes a three dimensional shaped housing, generally rectangular in configuration and with first 82, second 84, third 86 and fourth 88 interconnecting sides, these defining the female sub-assembly and further exhibiting both outwardly and inwardly facing surfaces, thus again defining a substantially open interior. The configuration and dimension of the interconnecting sides 82, 84, 86 and 88 is such that the female housing sub-assembly is slidably inserted between the interiorly facing surfaces of the male housing sub-assembly. The female sub-assembly housing further includes a forward and projecting frame 90 (defining a stop location for insertion in the male sub-assembly) and a rearwardly extending and keyed portion 92, secured to a top surface of the frame 90 and, as will be further explained, is engageable with the interiorly open receiving portion 34.

Additional features associated with the female sub-assembly housing 18 include a pair of bottom projecting rails 94, these extending in depth-wise extending fashion along a bottom outer surface (see side 86) and which are received within the depthwise recesses 28 of the male sub-assembly upon engagement. Yet additional features include additional depth-wise extending recesses 96 and 98 positioned along inner facing surfaces of sides 84 and 88, as are additional recesses 97 and 99 in association with the outer facing frame 90 (this further being to seat the extending key portions of the two piece seal retainer to be discussed). Additionally, first 100 and second 102 pairs of exteriorly projecting window portions are positioned proximate to both rearward and forward facing ends of the female housing sub-assembly 18 and similar to those previously referenced at 36 and 38 in FIGS. 5A and 5B.

Referring again to the exploded view of FIG. 3, additional features of the female sub-assembly 18 include the provision of another plurality of stackable and sandwiching components, these including individual terminal pin retaining layers 104, 106 and 108, a slit matt seal 110 and a two piece seal retainer (see substantially "L" shaped and assembleable components 112 and 114). Each of the terminal pin retaining layers 104, 106, and 108 are likewise, in a preferred embodiment, rectangular in shape and are capable of being constructed of an insulating or conductive material, depending upon the electrical needs of the connector assembly.

Again, and according to the preferred embodiment, each layer 104, 106 and 108 includes exteriorly projecting keys, or tabs, see such as at 116 and 118 for layer 104, at 120 and 122 for layer 106, and at 124 and 126 for layer 108. As with the tabs associated with male assembly retainer layers 40, 42 and 44, the uniquely configured and projecting tabs are intended to mate with the likewise uniquely/inwardly keyed recesses 96 and 98 of the female sub-assembly, these again further being positioned and individually dimensioned in length to receive each of the succeeding pin retainer layers 104, 106 and 108 in a likewise desired and predetermined spaced and stacking arrangement.

As is also again best illustrated in FIG. 3, each of the layers 104, 106 and 108 includes a plurality of configured apertures formed therethrough, these being selected from such as smaller circular shaped apertures (see at 128 for layer 104), as well as slot shaped 130, and oval/slot shaped apertures 132 and 134 (layers 106 and 108). Individual pluralities of female terminal pins, 136 for layer 104, 138 for layer 106 and 140 for layer 108, are provided.

As discussed in reference to the male sub-assembly, each sub-plurality of pins 136, 138 and 140 is dimensioned to a different length (such as the forward most layer 104 and pins 136 being the shortest and the rearward most layer 108 and pins 140 being the longest) and so that, upon assembly of the pins into specified circular shaped apertures (see again at 128) of each terminal layer 104, 106 and 108 of the female sub-assembly 18, the extending ends of the pins 136, 138 and 140 are all evenly arranged. As further illustrated, the extending ends of the female pins further exhibit open interiors which facilitate seating insertion and engagement by the opposingly extending and male terminal pins 66, 68 and 70.

The arrangement and configuration of the variously shaped apertures (e.g. at 128, 130, 132 and 134) is further such that the longest pins (see again 140 associated with rearward most layer 108) are able to pass through the preceding and forwardly located layers 104 and 106 in the assembled stacking arrangement of the female sub-assembly 18. As discussed in reference to the male sub-assembly, individual wire strands composing the second wire harness 14 are connected to associated rearward ends of likewise individual ones of the female terminal insertion pins 136, 138 and 140. As with the description of FIG. 2, the configuration of the slots and channels facilitates the clearance for previous layer terminal pins and wires and it is also contemplated and understood that any suitable plurality of retaining layers and associated terminal pins can also be installed into the female sub-assembly, the same likewise only being limited by practical space considerations.

Figure 4:
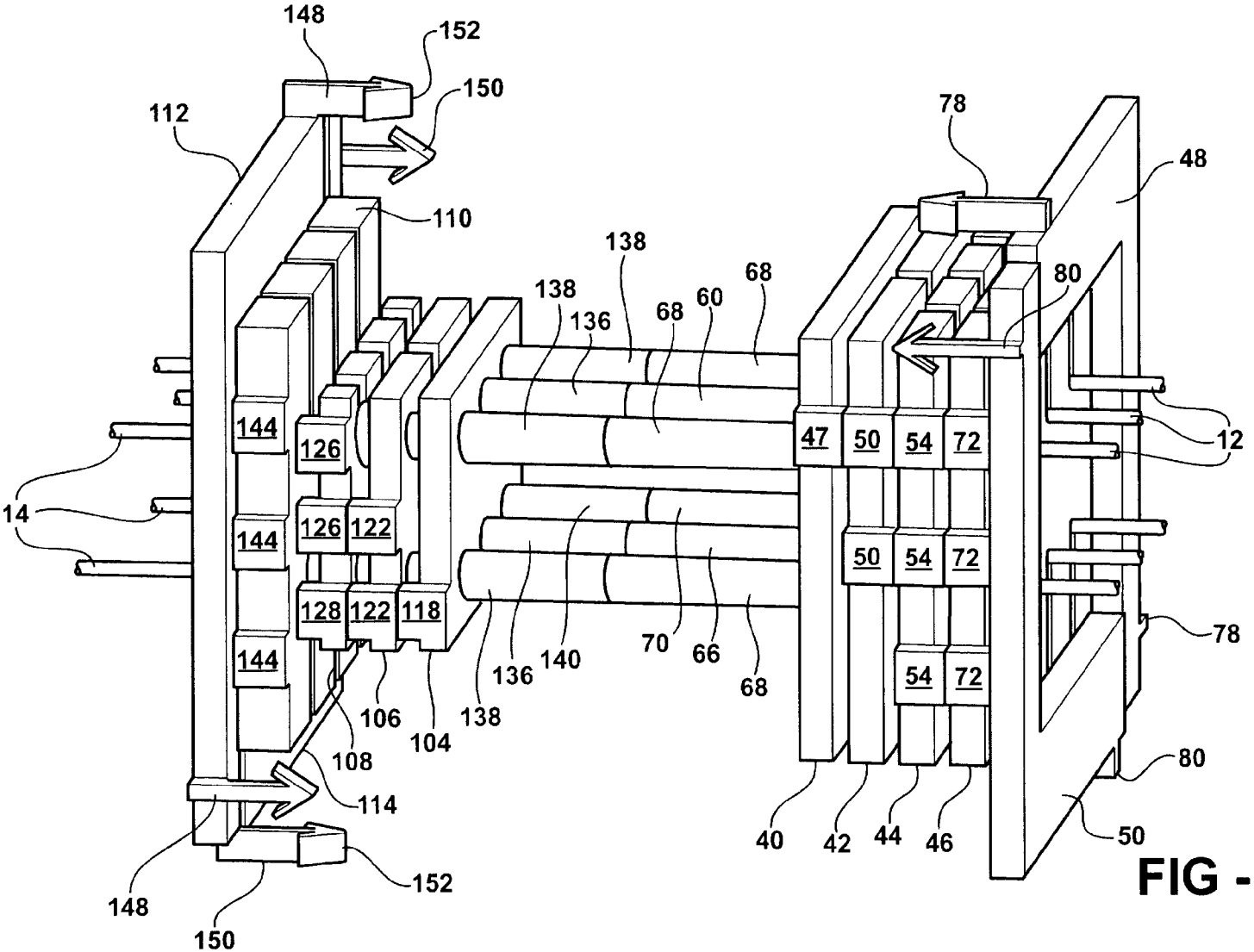
FIG. 4 is a cutaway view in perspective and illustrating the modularized/stackable nature of the terminal pin retention layers and associated/interengageable pins of the male and female subassembly portions.

Referencing further the rearwardly positioned slit matt seal 110 (again FIG. 3), the same is shaped similarly to each of the succeeding pin retainer layers 104, 106 and 108, and includes keyed or tabbed portions, see at 142 and 144 and for positioning the matt seal 110 in a rearward most location, as well as smaller sized slits 146 for allowing clearance of the harness wires 14 associated with the pins 136, 138 and 140. Finally, the two piece seal retainer, see again at 112 and 114, is also by necessity constructed in this fashion and so that it can be assembled around the wire harness extending from the female sub-assembly 18. Keyed portions 148 (for retainer portion 112) and 150 (for retainer portion 114) are configured (see arrow shaped pointed ends 152 in FIGS. 1, 2 and 4) to engage specified and associated window portions 100 and 102 and in order to secure the female assembly together in the manner again substantially illustrated in FIG. 1. Along with the seal retainer associated with the male sub-assembly, each of male and female seal retainers can be quickly disassembled to allow for easy addition (such as in the field) of extra module layers and in order to add new feature content to the connector assembly.

Figure 7:
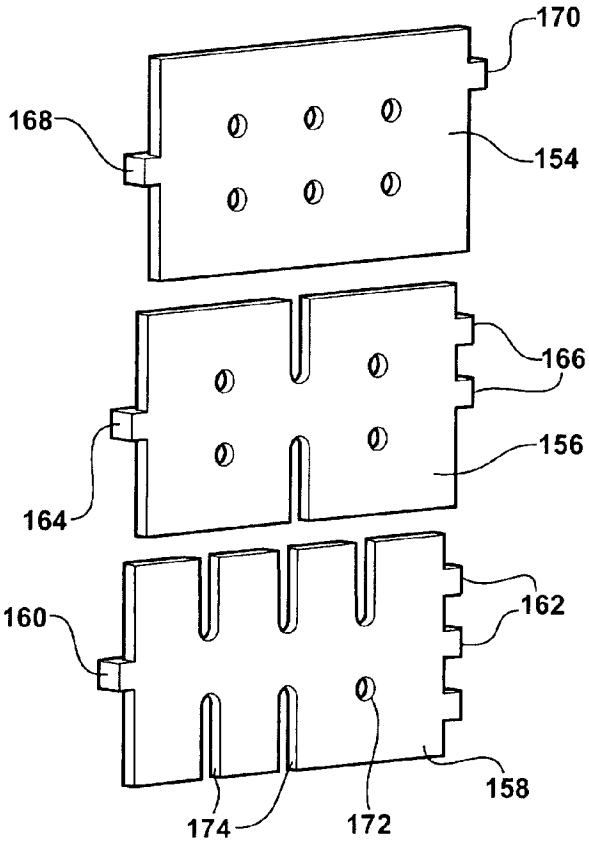
FIG. 7 is an exploded view of a selected array of module terminal layers according to the present invention.

Referring further to FIG. 7, an exploded view is illustrated of a further selected array of module terminal layers 154, 156 and 158 and which is intended only to build upon the disclosure of the sub-pluralities of various terminal retainer layers previously illustrated and discussed in reference to FIGS. 2 and 3. In particular, the reference of FIG. 7 is intended to illustrate that the infinite possibilities in the design and configuration of the pin retainer layers, each being keyed (see at 160 and 162 for layer 154, at 164 and 166 for layer 156, and at 168 and 170 for layer 158) for proper fit and assembly order, including again the necessary apertures (circular 172, slotted 174, etc.) providing the needed clearances for previous layer terminal pins and wires. As again previously described, the individual layers can be constructed of insulating or conductive materials, depending upon the electrical requirements of the connector assembly.

Figure 8:
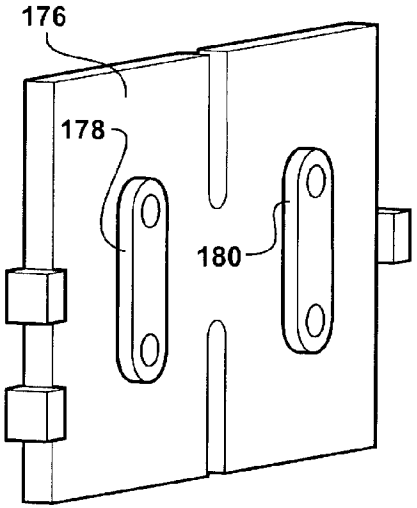
FIG. 8 is a sectional perspective view of a further selected terminal retention layer and which includes the provision of conductive inserts for shorting of pin terminals associated with succeeding layers.

Referring now to FIG. 8, a sectional perspective view of a further selected terminal retention layer 176 is shown and which includes the provision of conductive inserts 178 and 180 secured to a selected face of the layer 176. In use, terminal pins associated with the layer 176 are inserted and which, as desired, are shorted (electrically conducted) to selected associated and succeeding pin retainer layers (such as through the holes associated therewith and which are not shown) and in order to adapt the capabilities of the connector system. In this fashion, the shorting feature can be combined with all other features of the connector system.

Figure 9:
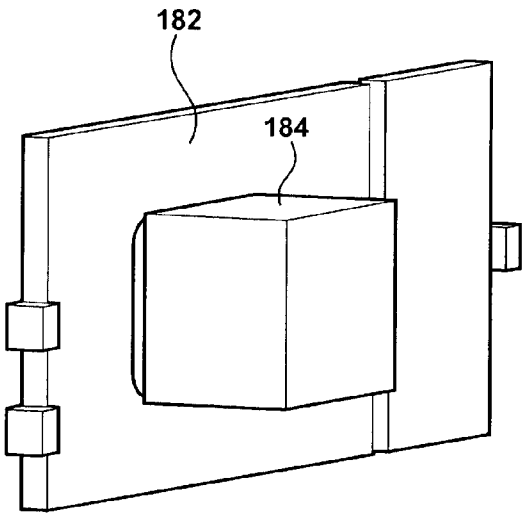
FIG. 9 is a sectional perspective view of a yet further selected terminal retention layer and illustrating a selected electrical component secured thereto.

Referring now to FIG. 9, a sectional perspective view is illustrated at 182 of a yet further selected terminal retention layer and which illustrates a selected electrical component, such as shown at 184, secured thereto. The electrical component 184 can be drawn from any of a number of known components, including active or passive electronic, electromechanical or mechanical components, such as fuses, relays, and the like, it being understood that the present invention contemplates the ability to add components to a given module layer.

Figure 12:
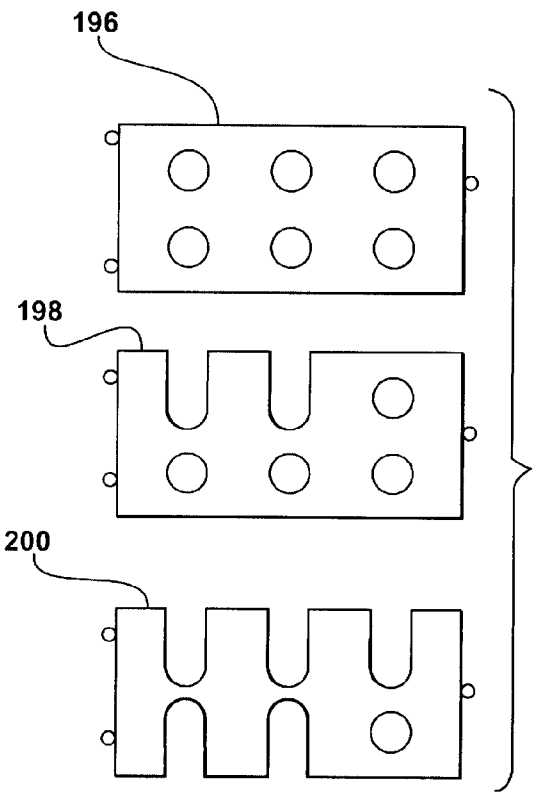
FIG. 12 is an exploded and planar view of the further selected array of module terminal layers also illustrated in FIG. 11.
Figure 10:
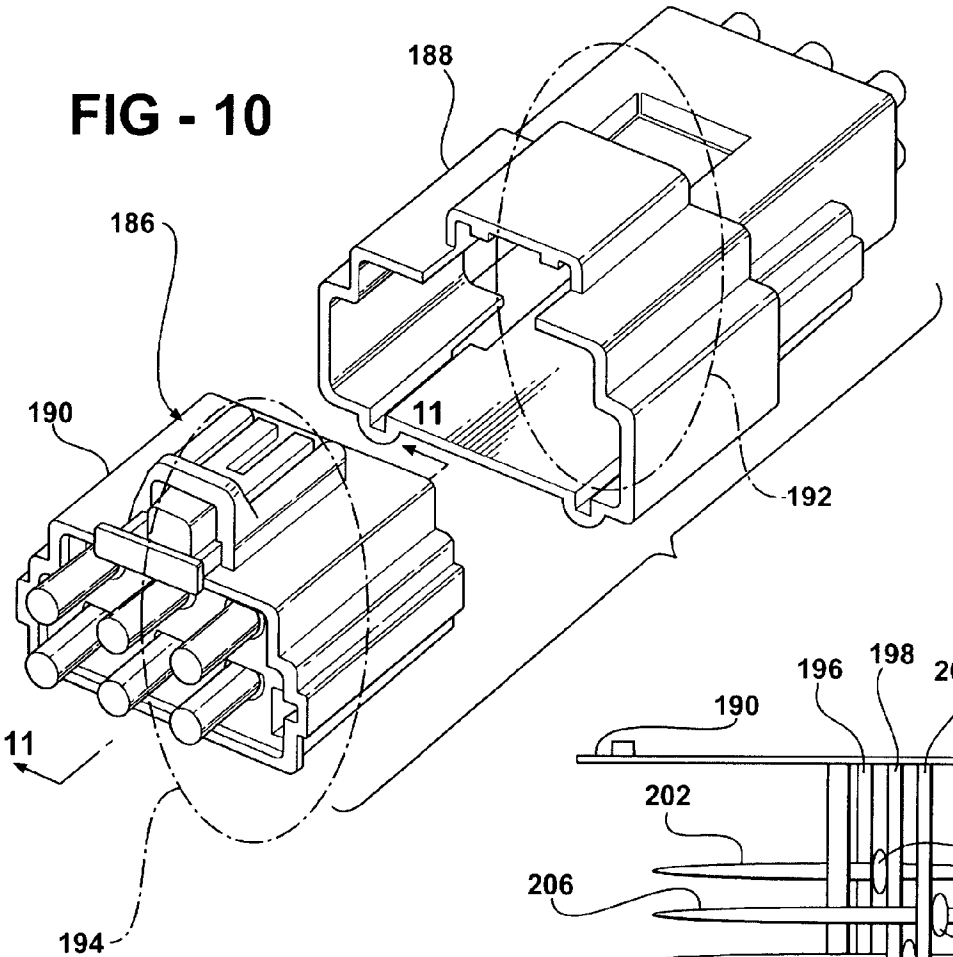
FIG. 10 is an exploded perspective view of an assembleable male/female module layered connector system and incorporating a conventionally designed housing retrofitted with the terminal retaining layers according to a further preferred embodiment of the present invention.
Figure 11:
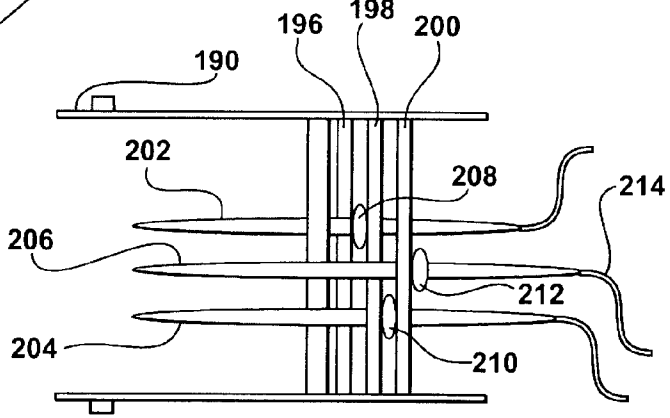
FIG. 11 is a side cutaway view, taken along line 11—11 of FIG. 10, and illustrating the stackable and spatial arrangement of a plurality of three terminal retention layers according to the present invention.

Referring finally to FIGS. 10–12, a series of views are shown of a slightly modified connector system 186 (FIG. 10) according to the present invention and which includes a conventionally designed male housing sub-assembly 188 and a corresponding conventionally designed female housing sub-assembly 190. The body sub-assemblies 188 and 190 further include integral connector pin supports and optional perimeter sealing structure (further not shown).

Referenced generally by oval circles 192 and 194 are further the general interior locations of layered stackable terminal retainer layers, and such as is further illustrated by layers 196, 198 and 200 associated with female sub-assembly 190 (circle 194) and further shown in FIGS. 11 and 12. As is again referenced by the side cutaway view of FIG. 11, an illustration is best shown of the stackable and spatial arrangement of the plurality of three terminal retention layers 196, 198 and 200 and best showing the manner in which extending ends of associated pins 202, 204 and 206, respectively for layers 196, 198 and 200, are aligned equally.

Additional components, such as conductive inserts 208, 210 and 212 may be provided for electrically shorting pin receiving apertures between succeeding layers and trailing harness wires 214 are further illustrated. Referring finally again to FIG. 12, the exploded and planar view of the further selected array of module terminal layers 196, 198 and 200 again references components, including edge extending tabs or projections, apertures, channels and slots, such as have been previously described, such that further and repetitive description herein is unnecessary.

The present invention therefore discloses a connector system exhibiting modular upgrade capabilities in either or both the male and female sub-assembly housings. It is further contemplated that, according to specific retrofit applications, a conventionally known male or female connector sub-assembly can be utilized in combination with a corresponding male or female sub-assembly as constructed according to the present disclosure.

Furthermore, and as has again been previously explained, any number of terminal retention layers can be incorporated into the present invention, and beyond the three layers illustrated for each sub-assembly. Along these lines, further examples include, without limitation, a five layer, twelve pin version of a male sub-assembly and a three layer twelve pin version of a female sub-assembly.

Having described my invention, other and additional preferred embodiments will become apparent to those skilled in the art to which it pertains, and without deviating from the scope of the appended claims.

What is claimed is:

1. A connector system for use with first and second wire harnesses, said system comprising:

a first housing to which is secured the first wire harness;

a second housing to which is secured the second wire harness, said second housing being engageable with said first housing and so as to define an open interior therebetween; and a first plurality of terminal pins associated with said first housing, a second plurality of opposingly extending and interconnecting terminal pins associated with said second housing, each of said housings further comprising a sub-assembly including at least one individual and stackable terminal pin retaining layer arranged within said open interior;

said stackable pin retaining layers providing the ability to adapt the capabilities of the connector system to allow for unique wire harness subsystems to be quickly assembled.

2. The connector system as described in claim 1, individual wires associated with the first and second wire harnesses extending to selected ones of said first and second pluralities of terminal pins.

3. The connector system as described in claim 1, further comprising a conductive insert secured between succeeding terminal pin retaining layers, said insert electrically shorting pin terminals associated with said succeeding layers.

4. The connector system as described in claim 1, further comprising an electrical component secured to a selected terminal pin retaining layer.

5. The connector system as described in claim 1, said first housing further comprising a male sub-assembly and said second housing further comprising a female sub-assembly, each of said male and female sub-assemblies exhibiting a specified shape and size and wherein said female sub-assembly is insertably engaged within said male sub-assembly.

6. The connector system as described in claim 5, further comprising an elongate extending and keyed portion extending from said female sub-assembly, a receiving portion being defined upon a surface of said male sub-assembly and receiving said extending keyed portion upon slidable insertion of said male sub-assembly over said female subassembly.

7. The connector system as described in claim 5, said male and female sub-assemblies each further comprising a plurality of individual and stackable terminal pin retaining layers, individual subset pluralities of said pins, corresponding to given retaining layers, exhibiting a specified overall length.

8. The connector system as described in claim 5, each of said male and female sub-assemblies further comprising a plurality of depth-wise extending recesses extending along selected inner surfaces thereof, each of said terminal pin retaining layers further comprising projecting tab portions seating within selected recesses.

9. The connector system as described in claim 5, said male sub-assembly further comprising at least one inwardly recessed groove extending along a selected inner surface thereof, a depth-wise extending rail projecting from a corresponding outer surface of said female sub-assembly and seating within said recessed groove upon inserting engagement between said sub-assemblies.

10. The connector system as described in claim 1, further comprising first and second seal retainers associated with exposed and oppositely extending ends of said first and second housings.

11. The connector system as described in claim 10, said seal retainers each further comprising a slit matt seal and an end-assembleable two piece seal retainer.

12. The connector system as described in claim 11, further comprising first and second pairs of projecting window portions associated with each of said first and second housings, said window portions receiving keyed portions associated with each of said two-piece and assembleable seal retainers.

13. The connector system as described in claim 11, said matt seal further comprising a plurality of extending slits for providing wire harness clearance.

14. The connector system as described in claim 1, each of said stackable terminal pin retaining layers further comprising a selected array of apertures defined therethrough.

15. The connector system as described in claim 14, said aperture array defined through each of said pin retaining layers further including at least one of a circular, oval and channel shaped aperture.

16. A connector system for use with first and second wire harnesses, said system comprising:

a male housing sub-assembly to which is secured the first wire harness;

a female housing sub-assembly to which is secured the second wire harness, said female sub-assembly being engageable with said male sub-assembly and so as to define an open interior therebetween; and first and second pluralities of terminal pins associated with said male and female sub-assemblies, at least one of said sub-assemblies further comprising a plurality of individual and stackable terminal pin retaining layers;

said stackable pin retaining layers providing the ability to adapt the capabilities of the connector system to allow for unique wire harness subsystems to be quickly assembled.

17. A connector system for use with first and second wire harnesses, said system comprising:

a male housing sub-assembly;

a female housing sub-assembly engageable with said male sub-assembly and so as to define an open interior therebetween;

first and second pluralities of terminal pins associated with said male and female sub-assemblies, individual wires associated with each of the first and second wire harnesses extending to selected ones of the first and second pluralities of terminal pins;

each of said male and female sub-assemblies further comprising a plurality of individual and stackable terminal retaining layers to which subset pluralities of said pins are secured;

said stackable pin retaining layers providing the ability to adapt the capabilities of the connector system to allow for unique wire harness subsystems to be quickly assembled.

* * * * *